US009694226B1

(12) United States Patent
Vargas et al.

(10) Patent No.: US 9,694,226 B1
(45) Date of Patent: Jul. 4, 2017

(54) EXERCISE WHEEL

(71) Applicants: Dov Vargas, Bohemia, NY (US); Raquel Vamos, Bohemia, NY (US)

(72) Inventors: Dov Vargas, Bohemia, NY (US); Raquel Vamos, Bohemia, NY (US)

(73) Assignee: Raw Love Inc., Huntington, NY (US)

( * ) Notice: Subject to any disclaimer, the term of this patent is extended or adjusted under 35 U.S.C. 154(b) by 0 days.

(21) Appl. No.: 15/146,038

(22) Filed: May 4, 2016

(51) Int. Cl.
*A63B 21/002* (2006.01)
*A63B 21/00* (2006.01)
*A61H 1/02* (2006.01)

(52) U.S. Cl.
CPC ..... *A63B 21/0004* (2013.01); *A61H 1/02* (2013.01)

(58) Field of Classification Search
CPC ..... A63B 21/00
USPC ..... 601/20; 482/132, 49
See application file for complete search history.

(56) References Cited

U.S. PATENT DOCUMENTS

| | | | | |
|---|---|---|---|---|
| 6,306,109 | B1 * | 10/2001 | Polychronis | A61H 15/0092 601/128 |
| 7,837,603 | B1 | 11/2010 | Carnell, Sr. | |
| 9,005,146 | B2 * | 4/2015 | Phillips | A61H 15/0092 482/132 |
| 9,486,387 | B2 * | 11/2016 | Crowell | A61H 15/0092 |
| 2009/0192028 | A1 | 7/2009 | Shank | |
| 2010/0210977 | A1 | 8/2010 | Casha | |
| 2013/0029815 | A1 | 1/2013 | Lu | |

OTHER PUBLICATIONS https://web.archive.org/web/20150406061254/http://www.dharmayogawheel.com/store/c1/Featured_Products.html,archived page from Apr. 6, 2015.

* cited by examiner

*Primary Examiner* — Jerome W Donnelly
(74) *Attorney, Agent, or Firm* — Dorf & Nelson LLP; Scott D. Locke, Esq.

(57) ABSTRACT

A device for stretching and practicing yoga is provided in the form of a wheel that has padding on an outer side. On the inner side of the wheel are contours for gripping.

20 Claims, 4 Drawing Sheets

EXERCISE WHEEL

FIELD OF THE INVENTION

The present invention relates to the field of devices for health and fitness.

BACKGROUND OF THE INVENTION

Yoga has long been known to be beneficial to a person's mind and body. Among the benefits of yoga that people tout are improved clarity of thought and improved flexibility. In order for a person who practices yoga to optimize his or her experience, he or she might seek new environments, more comfortable clothing, and/or better equipment.

For example, some persons choose to take yoga classes in hot rooms. Proponents of hot yoga often tout benefits that include detoxification and more efficient development of strength, flexibility, and tone.

Some persons also choose to wear yoga pants in order to move and to stretch more easily while practicing yoga. Examples of this type of apparel are sold under the trademarks Manduka®, Athleta®, and lululemon Athletica®.

With respect to equipment, there have been proposals to use, for example, blocks, see U.S. 2013/0029815, published Jan. 31, 2013, and wedges, see U.S. 2009/0192028, published Jul. 30, 2009. The purpose of these and other devices is to allow participants to practice their yoga postures more effectively.

The present invention provides an additional novel and non-obvious device that may be used to improve a user's yoga experience.

SUMMARY OF THE INVENTION

The present invention provides a yoga stretching and fitness exercise device, as well as methods for using this device. Through the use of various embodiments of the present invention, a person is able to practice yoga and to stretch more efficiently and effectively.

According to a first embodiment, the present invention is directed to a device for yoga comprising: (a) a wheel, wherein the wheel has an inner side and an outer side, wherein at each point on the inner side of the wheel, a first radius defines a distance from the center of the wheel to the inner side, and for each first radius, there is a corresponding second radius that defines a distance from the center of the wheel to the outer side, wherein the second radius is equal to the sum of the first radius and the thickness of the wheel between said point and the outer side along the second radius; and (b) padding, wherein the padding is affixed to the outer side, wherein the inner side of the wheel contains at least one, and preferably a plurality of regions, that are defined by a maximum first radius and at least one, and preferably a plurality of regions, that are defined by a minimum first radius, wherein the minimum first radius is smaller than the maximum first radius.

According to a second embodiment, the present invention is directed to a method of stretching comprising: (a) grasping a device for yoga, wherein said device comprises (i) a wheel, wherein the wheel has an inner side and an outer side, wherein at each point on the inner side of the wheel, a first radius defines a distance from the center of the wheel to the inner side, and for each first radius, there is a corresponding second radius that defines a distance from the center of the wheel to the outer side, wherein the second radius is equal to the sum of the first radius and the thickness of the wheel between said point and the outer side along the second radius; and (ii) padding, wherein the padding is affixed to the outer side, wherein when grasping the device, the user places one or more of his or her fingers at one or more regions that are defined by a maximum first radius; wherein the inner side of the wheel contains at least one, and preferably a plurality of regions, that are defined by the maximum first radius and at least one, and preferably a plurality of regions, that are defined by a minimum first radius, wherein the minimum first radius is smaller than the maximum first radius; and (b) exerting force on the device, wherein the force comprises all or a portion of the user's weight.

Through the various embodiments of the present invention, one is able to design and to use a device for yoga stretching and fitness.

DETAILED DESCRIPTION OF THE INVENTION

Figure 1:
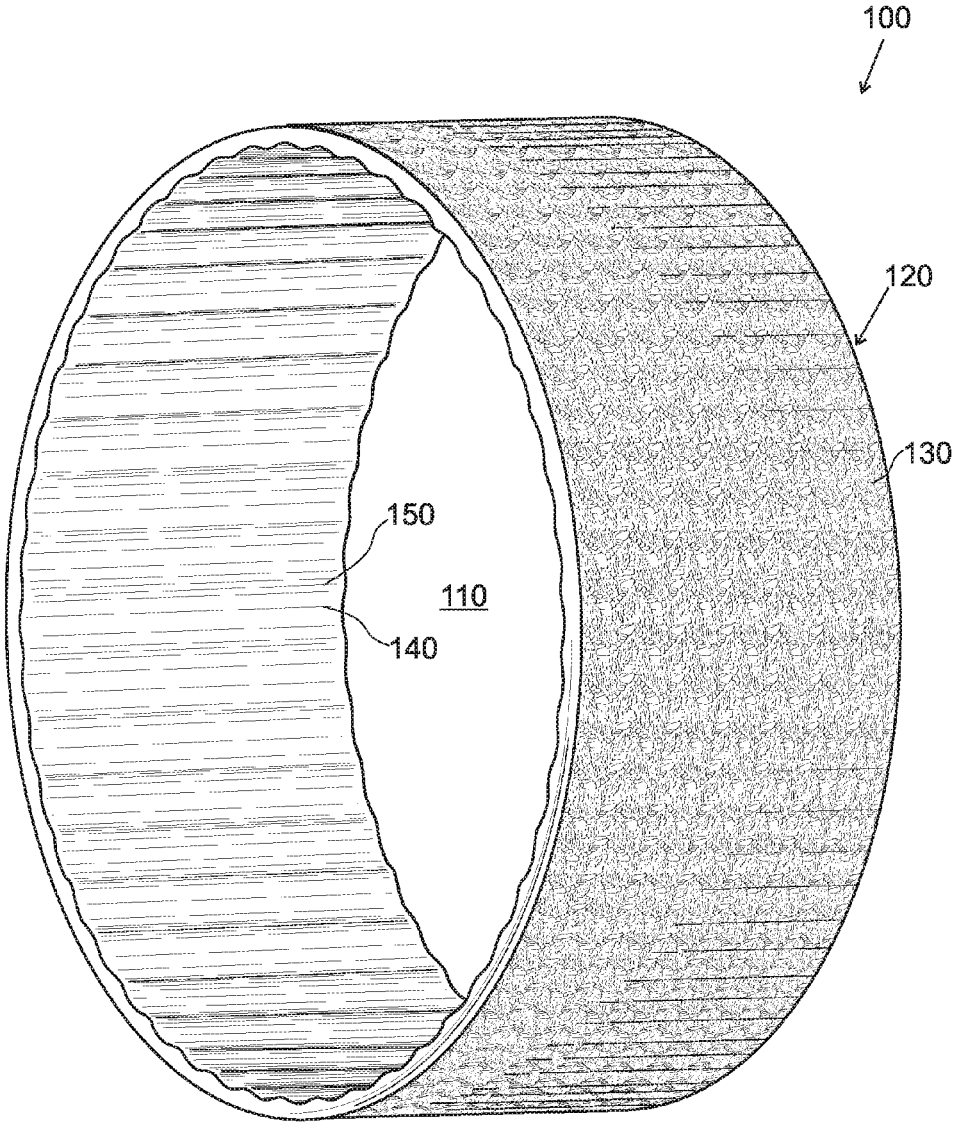
FIG. 1 is a representation of a device of the present invention.
Figure 2:
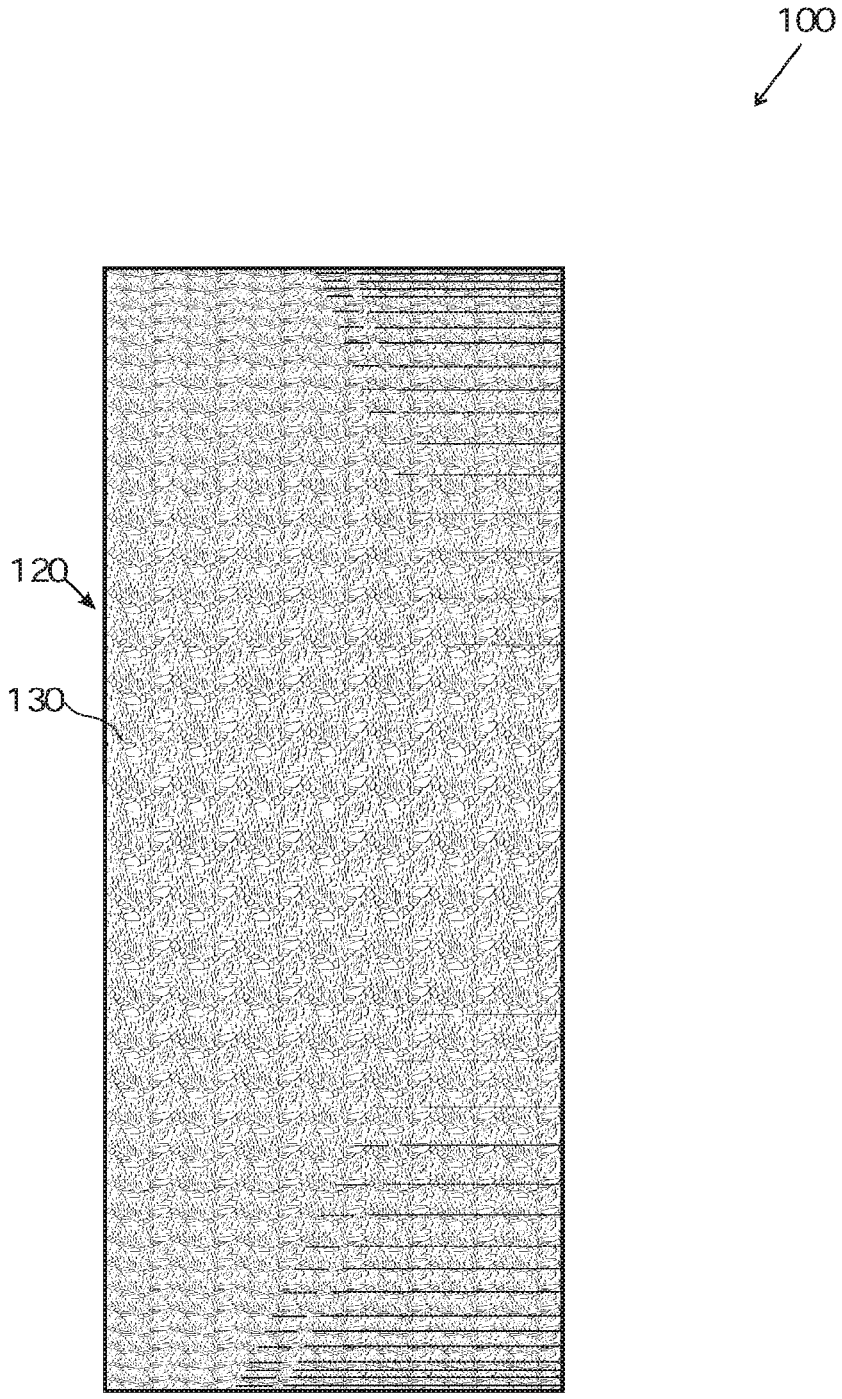
FIG. 2 is a representation of another view of the device of FIG. 1.
Figure 3:
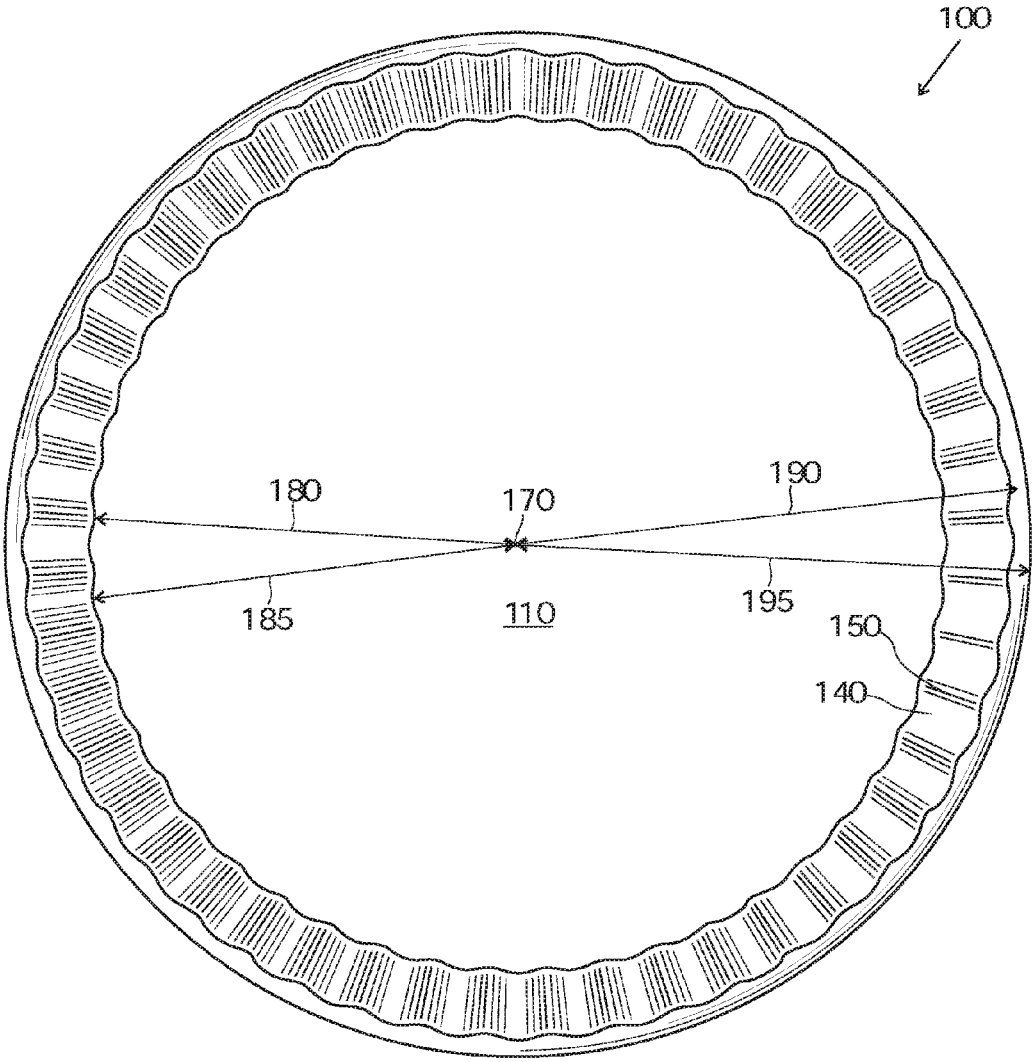
FIG. 3 is also a representation of another view of the device of FIG. 1.
Figure 4:
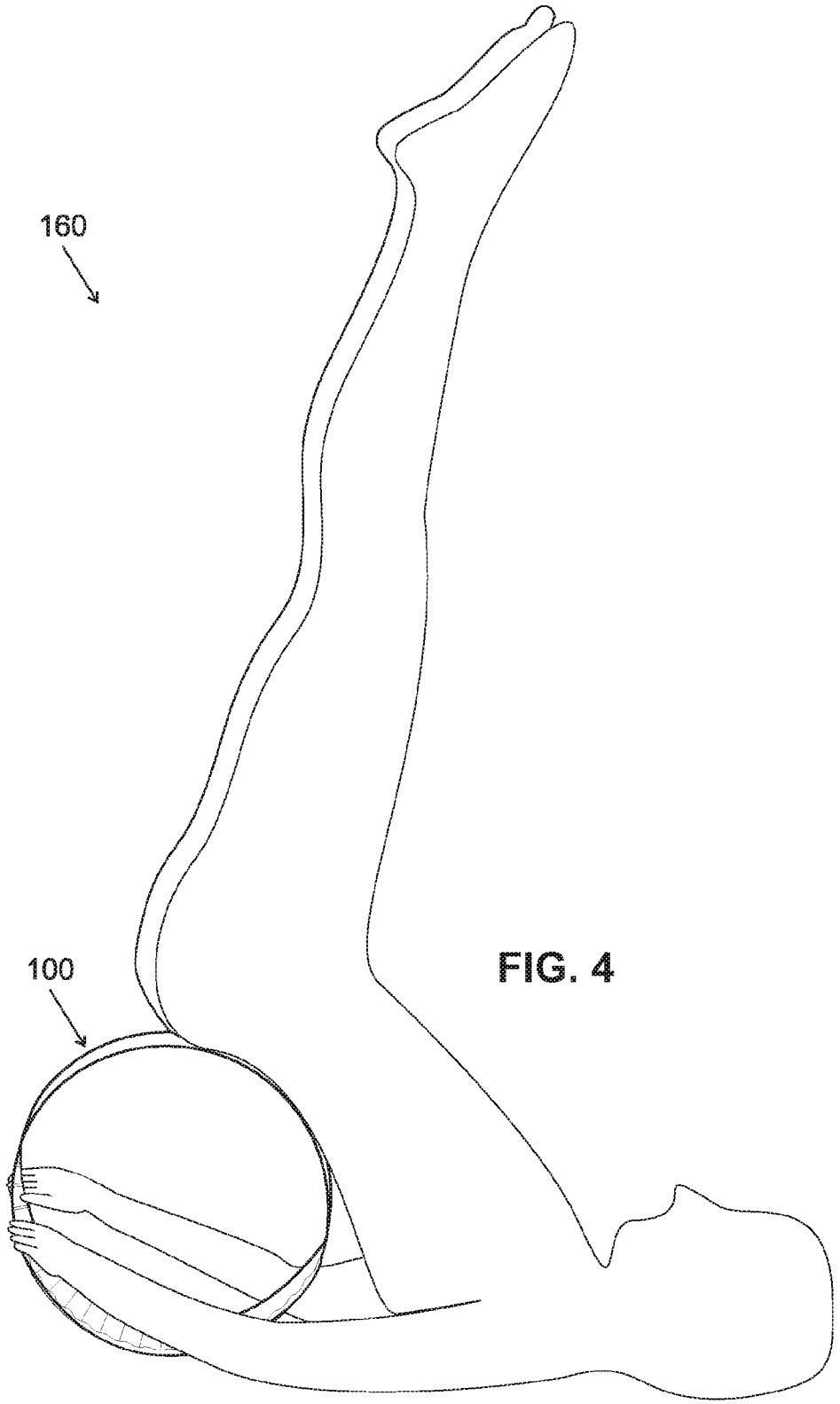
FIG. 4 is a representation of a person using a device of the present invention.

Reference will now be made in detail to various embodiments of the present invention, examples of which are illustrated in the accompanying figures. In the following detailed description, numerous specific details are set forth in order to provide a thorough understanding of the present invention. However, unless otherwise indicated or implicit from context, the details are intended to be examples and should not be deemed to limit the scope of the invention in any way.

According to a first embodiment, the present invention provides a device for yoga. The device comprises a wheel 100 and padding 120. Optionally, it also comprises guides that are located along the sides of the wheel, wherein the padding is located between the guides.

The wheel has an inner side and an outer side. The inner side of the wheel defines an outer boundary of a space or lumen 110. The space or lumen, although bounded on its sides by the inner side of the wheel, in some embodiments may have a complete or partial absence of other structures or enclosures, thereby rendering the lumen or space completely or partially open on opposite ends. Each point on the inner side of the wheel is defined by a first radius, which is the distance from the center of the wheel to the inner side. As persons of ordinary skill in the art will recognize a wheel may have a cylinder shape or substantially cylindrical or tubular shape. The center of the wheel is the center of each cross-section of the wheel, which is a point, and these points together define a line or axis. If there is a structure that corresponds to this line, that structure may be an axle. However, in many embodiments of the present invention, there is no axle or corresponding structure, and the line is a theoretical axis 170, i.e., reference to it provides a way to describe a dimension of the cylinder or wheel, and when viewing a cross-section of the wheel appears as a point.

First radii are measured by the shortest distance from each point on the inner side to this axis, and in some embodiments, the inner side of the wheel defines a space that has an absence of any physical structures. Here, the center of the wheel is the theoretical line that forms an imaginary axis.

In some embodiments, the inner side of the wheel is contiguous and contains one or more of: one or more regular or irregular concave regions; one or more regular or irregular convex regions; one or more textured regions; and one or more smooth regions or combinations thereof. In some embodiments, the inner side of the wheel has an absence of one or more of concave regions, convex regions, textured regions and/or smooth regions. By way of a non-limiting example, there may be one or more regions that are defined by the maximum first radius 185, each of which is in the form a concave surface.

These concave surfaces 140 may, for example, form troughs that are of a consistent size that are regularly or irregularly spaced along the inner side. In some embodiments, each concave surface forms a trough, and the trough spans from a first side edge of the inner side to a second side edge of the inner side and thus spans from, for example, a left side of the wheel to the right side of the wheel. Part or all of the troughs may be textured and/or smooth. In some embodiments, there are two to sixty troughs or four to forty troughs or ten to thirty troughs.

In some embodiments, between the troughs, there may be convex surfaces 150 and/or flat regions and/or other regular or irregular regions. The curvature of each trough may, for example, correspond to that of fingers and each may be large enough to receive a finger. The regions between the troughs may be referred to as ridges, regardless of their shapes. Every point along the inner side may be defined by a first radius, and the inner side may thus be defined by a plurality of first radii. In some embodiments, as one moves along a trough from a left side to a right side of the wheel, the first radii may be constant, but as one moves from a concave region to a convex region, the first radii may decrease, e.g., from the maximum first radius to the minimum first radius.

In some embodiments, for each trough, there is a midline. When all troughs are the same size, the radius of the wheel that corresponds to the midline is the maximum first radius. The distance between midlines of a pair of consecutive troughs may, for example, be between 0.5 and 5.0 centimeters or between 2.0 and 4.0 centimeters; and between midlines of at least one pair of consecutive troughs, there is a region that, when all regions between troughs have the same configuration, may be defined by a minimum first radius. In some embodiments, the regions that are defined by the maximum first radius and the regions that are defined by the minimum first radius alternate over 360 degrees of the inner side. As persons of ordinary skill in the art will appreciate, the troughs may have the same shape and size such that a maximum first radius defines the depth of all troughs. Similarly, all ridges may have the same shape and size such that a minimum first radius defines the height of all ridges. In other embodiments, there is a plurality of troughs that have different depths and/or a plurality of ridges that have different heights. In these latter scenarios, each distinctively sized trough and distinctively sized ridge may be defined by different radii, but the maximum first radius defines the longest distance from the center of the wheel to any of the locations on the inner side of the wheel, and the minimum first radius is the minimal distance to any of the locations on the inner side.

In some embodiments, the difference between the maximum first radius 185 and the minimum first radius 180 is between 0.25 cm and 3.0 cm or between 1 cm and 2 cm.

As noted above, in some embodiments, not all of the first radii are the same in the wheel. In these embodiments, the inner side of the wheel may contain one, or a plurality of regions, but not all regions that are defined by a maximum first radius and one or a plurality of regions, but not all regions that are defined by a minimum first radius, wherein the minimum first radius is smaller than the maximum first radius. In these embodiments, the wheel may or may not have a non-uniform thickness.

The concave regions may be designed to facilitate gripping, and to reduce or to eliminate the slipping or sliding of one's fingers or losing of one's grip, by having cavities (or troughs) that are configured to receive one's fingers.

For each first radius, there is a corresponding second radius 190 that defines a distance from the center of the wheel to the outer side. The second radius is equal to the sum of the first radius and the thickness of the wheel between the corresponding point of the first radius and the outer side along the second radius. In some embodiments, all points on the outer side of the wheel are a uniform distance from the axis of the wheel, and thus, all second radii are equal. In other embodiments, they are not a uniform distance from the axis, but the range of second radii differ by less than 5 mm, less than 4 mm, less than 3 mm, less than 2 mm or less than 1 mm. When all second radii are not equal, the thickness of the wheel may be uniform, or non-uniform e.g., thereby defining a wheel with a sinusoidal rim.

The device also comprises padding. The padding is affixed to the outer side. In some embodiments, the padding is smooth. In other embodiments it is textured 130. In still other embodiments, the wheel may be partially smooth and partially textured on its surface that is to be exposed to the user i.e., not contacting the wheel. When the padding is textured, it may contain one more regions that are raised or contain depressions. When there are regions that are raised or that contain depressions, preferably, the thickness (also referred to as height) of the padding varies by no more than 5 mm, or no more than 4 mm, or no more than 3 mm, or no more than 2 mm, or no more than 1 mm. The distance from the theoretical axis to the exterior edge of the padding (the side distal from the wheel) at any point may be defined by a third radius 195, which is longer than the second radius.

The padding also has a bottom surface. The bottom surface may be affixed to the outer side of the wheel by glue or other adhesive material, such as an epoxy. The bottom surface may be smooth or may have some texturing to facilitate adhesion. Similarly, the outer side of the wheel may be flat or have some texturing to facilitate adhesion.

In some embodiments, the second radius is between 15 and 24 centimeters or 18-21 centimeters, and the distance between the first side edge and second side edge (the width of the wheel) is between 10 and 100 cm, or between 20 and 80 cm, or between 30 and 60 cm. In some embodiments, the padding covers 360 degrees of the outer side of the wheel and spans from the first (e.g., left) side edge to the second (e.g., right) side edge. This is the width of the wheel, which corresponds to the height of the cylinder shape that defines the wheel. By way of a non-limiting example, the padding may be a yoga mat. In some embodiments, the padding has a top surface, and the top surface is either smooth or non-smooth, i.e., it is textured. The texturing may, for example, be in the form of nibs or a basket weave or ridges or other regular or irregular pattern. As persons of ordinary skill in the art know, padding such as the type in commercially available yoga mats may be made of compressible material, e.g., foam.

Optionally, the device may also comprise or have an absence of guides on each of its first side edge and its second side edge. These guides, when present, may be positioned along the sides of the wheel in order to form a boundary for the padding or they may be elevations of material along the edges of the outer side of the wheel of the device. When present, the guides may have a uniform or non-uniform first radius that defines the inner side of the guides. Preferably, they have a uniform radius, e.g., a first radius that is the same as the maximum first radius of the wheel, a first radius that is the same as the minimum first radius of the wheel, or a first radius that is between the maximum first radius of the wheel and the minimum first radius of the wheel. If guides are present, preferably, each is less than 2 cm thick or less than 1 cm thick or less than 0.5 cm thick.

Each guide also has a second radius. In some embodiments, the second radius of the guides is uniform and greater than the second radius of the wheel. In some embodiments, the difference between the size of the second radius of the guides and the second radius of the wheel may be the same as the maximum thickness of the padding or the same as the thickness of the padding when the padding has a uniform thickness. In other embodiments, the difference in the size of the second radius of the guides and the second radius of the wheels may be less than the maximum thickness of the padding, e.g., less than 90%, less than 80%, less than 70%, less than 60%, less than 50%, less than 40%, or less than 30% of the thickness of the padding. Additionally or alternatively, the difference in the size of the second radius of the guides and the second radius of the wheels may be less than the thickest portion of the padding but more than 80% of that thickness, more than 70% of that thickness, more than 60% of that thickness, more than 50% of that thickness, more than 40% of that thickness, more than 30% of that thickness, or more than 20% of that thickness. If the padding is compressible, the aforementioned heights of the guides are compared to the uncompressed padding.

If guides are present, they may be contiguous with the wheel and either formed with the wheel as part of one structure or attached to the wheel. Additionally, if the guides are present, the padding may span from one guide the other so that none of the outer side of the wheel is exposed.

The devices of the present invention will preferably be designed to support loads that are equal to or in excess of the weight of a human. For example, in some embodiments, the device is capable of bearing a load of up to 150 kilograms. The wheel portion of the device, and guides if present, may, for example, each independently comprise, consist essentially of, or consist of plastic, such as PVC, fiberglass, metal, a metal alloy, or a combination thereof. The padding may, for example, comprise, consist essentially of, or consist of plastic and/or rubber or a combination thereof. Optionally, the padding contains an outer housing of, for example, plastic, and within it, there is one or more of foam, beads, or rubber.

In some embodiments, among the advantages of the devices is that they are strong, light weight and stream-lined. In order to optimize the degree to which the device is light weight, there may be an absence of one or both of any axles or spokes or other additional physical structures. Thus, in some embodiments, the device consists of only the wheel and padding or only the wheel, padding, and guides.

The inner side of the wheel described above may be contoured to guide the placement of and/or to receive one or more of a user's fingers and to facilitate retention by the user of the device. Thus, by way of example, when there are concave regions or troughs, preferably they are wide enough to allow for the placement of a finger in a trough or four consecutive fingers in consecutive troughs.

In some embodiments, the device is designed such that all regions of the padding are substantially the same, if not the same, over 360 degrees. Similarly, preferably, there is uniformity in the troughs and ridges over 360 degrees. By being uniform over 360 degrees, a user need not be concerned where he or she picks up the device or exerts force on it.

According to another embodiment, the present invention is directed to a method of stretching one's body. The method may comprise grasping the device of any of the embodiments of the present invention by a user, wherein the user places one or more of the user's fingers at one or more regions that are defined by the maximum first radius; and exerting force on the device, wherein the force comprises all or a portion of the user's weight. The stretching may, but is not required to, be part of the practice of yoga.

A user 160 may grasp the device by placing fingers from each of his or her hands alone the inside surface 140 of the wheel 100 and his or her thumbs along the padding 120. He or she may then position the device so as to allow him or her to stretch a region of the body, for example, one's back, one's neck, one's torso, or one's legs. A person may put all of his or her weight on the device or only a portion of his or her weight on the device.

Any of the features of the various embodiments described herein can be used in conjunction with features described in connection with any other embodiments disclosed, unless otherwise specified. Thus, features described in connection with the various or specific embodiments are not to be construed as not suitable in connection with other embodiments disclosed herein, unless such exclusivity is explicitly stated or implicit from context.

We claim:

1. A device for yoga comprising:

(a) a wheel, wherein the wheel has an inner side and an outer side, wherein at each point on the inner side of the wheel, a first radius defines a distance from the center of the wheel to the inner side, and for each first radius, there is a corresponding second radius that defines a distance from the center of the wheel to the outer side, wherein the second radius is equal to the sum of the first radius and the thickness of the wheel between the corresponding point on the inner side and the outer side along the second radius; and (b) padding, wherein the padding is affixed to the outer side, wherein the inner side of the wheel contains a plurality of regions that are defined by a maximum first radius and a plurality of regions that are defined by a minimum first radius, wherein the minimum first radius is smaller than the maximum first radius.

2. The device of claim 1, wherein each maximum first radius corresponds to a distance from a center axis of the wheel to a base of a concave surface.

3. The device of claim 2, wherein each concave surface forms a trough, wherein the trough spans from a first side edge of the inner side to a second side edge of the inner side.

4. The device of claim 3, wherein for each trough: there is a midline; the radius of the wheel that corresponds to the midline is the maximum first radius; the distance between midlines of a pair of consecutive troughs is between 0.5 and 5.0 centimeters; and between midlines of at least one pair of consecutive troughs, there is a region that is defined by a minimum first radius.

5. The device of claim 4, wherein there are a plurality of regions that are defined by the minimum first radius and the regions that are defined by the maximum first radius and the regions that are defined by the minimum first radius alternate over 360 degrees of the inner side.

6. The device of claim 5, wherein the inner side is smooth.

7. The device of claim 5, wherein the inner side comprises one or more textured regions.

8. The device of claim 5, wherein the difference between the maximum first radius and the minimum first radius is between 0.25 cm and 3.0 cm.

9. The device of claim 8, wherein the padding covers 360 degrees of the outer side of the wheel.

10. The device of claim 9, wherein the padding is a yoga mat.

11. The device of claim 10, wherein the padding has a top surface, and the top surface is textured.

12. The device of claim 11, wherein the top surface is in the form of nibs.

13. The device of claim 11, wherein the top surface is in the form of a basket weave.

14. The device of claim 10, wherein the padding has a bottom surface, wherein the bottom surface is affixed to the outer side by glue.

15. The device of claim 9, wherein the second radius is between 15 and 24 centimeters.

16. The device of claim 15, wherein the distance between the first side edge and second side edge is between 30 and 60 cm.

17. The device of claim 16, wherein the wheel is capable of bearing a load of up to 150 kilograms.

18. The device of claim 17, wherein the device neither contains nor is attached to any spokes.

19. The device of claim 18, wherein the device neither contains nor is attached to an axle.

20. A method of stretching comprising:

(a) grasping the device of claim 1 by a user, wherein the user places one or more of his or her fingers at one or more regions that are defined by the maximum first radius; and (b) exerting force on the device, wherein the force comprises all or a portion of the user's weight.

* * * * *